US005788081A

United States Patent [19]

Bates

[11] Patent Number: 5,788,081

[45] Date of Patent: Aug. 4, 1998

[54] COMPARTMENTED TRAY

[75] Inventor: Aaron Bates, Marietta, Ga.

[73] Assignee: The Mead Corporation, Dayton, Ohio

[21] Appl. No.: 753,145

[22] Filed: Nov. 20, 1996

[51] Int. Cl.[6] ..... B65D 1/36

[52] U.S. Cl. ..... 206/562; 229/240; 229/904

[58] Field of Search ..... 206/217, 216, 206/562; 229/120.18, 240, 902, 904, 906; 426/115

[56] References Cited

U.S. PATENT DOCUMENTS

| | | | |
|---|---|---|---|
| 2,670,124 | 2/1954 | Buchmiller et al. | 229/904 |
| 2,924,372 | 2/1960 | Kirkeby | 229/904 |
| 3,149,770 | 9/1964 | Spillson | 206/562 |
| 3,637,130 | 1/1972 | Farquhar | 229/904 |
| 4,511,042 | 4/1985 | Wischusen, III | 229/904 |
| 4,572,423 | 2/1986 | Spencer | 229/904 |
| 4,757,937 | 7/1988 | Maio et al. | 229/904 |
| 5,205,474 | 4/1993 | Stuart et al. | 229/904 |

*Primary Examiner*—David T. Fidei
*Attorney, Agent, or Firm*—Michael V. Drew

[57] ABSTRACT

A multiple product container has at least one tubular compartment disposed adjacent a tray compartment. The tubular compartment has at least one aperture at its top-most portion for extraction of an elongated product and retention of the elongated product in an upright disposition. A tear strip further facilitates removal of the elongated product from the tubular compartment.

5 Claims, 3 Drawing Sheets

18
10
12
16
20
14
124
60
20
106
18
84
40
44

COMPARTMENTED TRAY

FIELD OF THE INVENTION

The present invention relates generally to a product container, and, more particularly, to a compartmented tray-type container for transporting multiple products.

BACKGROUND OF THE INVENTION

Multiple product containers are used to transport several products at a time. For example, a multiple product container may be used at stadium events to transport snacks and beverages, or may be used to deliver pizza orders. Some such containers consist of a paper tray with an opening for holding a beverage cup and a space for the food items. While such trays are simple and economical, they allow heat transfer from the hot food items to the cold beverage which is undesirable. Other containers are in the form of a box structure typically constructed of corrugated paperboard or heavy gauge paper stock, and come to the food server assembled thereby requiring vast amounts of storage space. Therefore, it will be appreciated that it would be highly desirable to have a multiple product container that is constructed of thin stock, that comes to the food server in a flat condition requiring minimum storage space, and that may be used to both transport and serve multiple products.

SUMMARY OF THE INVENTION

The present invention is directed to overcoming one or more of the problems set forth above. Briefly summarized, according to the present invention, a multiple product container has a partition dividing the container into a food compartment and a beverage compartment for a beverage permitting hot food and cold beverages to be transported in a single container. The beverage compartment is a tube having an opening for holding a beverage container in an upright position. The bottom wall of the food compartment is reinforced. The multiple product compartmented tray is formed from a blank and arrives to the food server partially assembled but collapsed flat. The food server erects the collapsed portion of the container and inserts the beverage containers in the tubular compartment formed. A pull tab and tear strip facilitate easy access to the beverage containers in the tubular beverage compartment.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figures 1, 4:
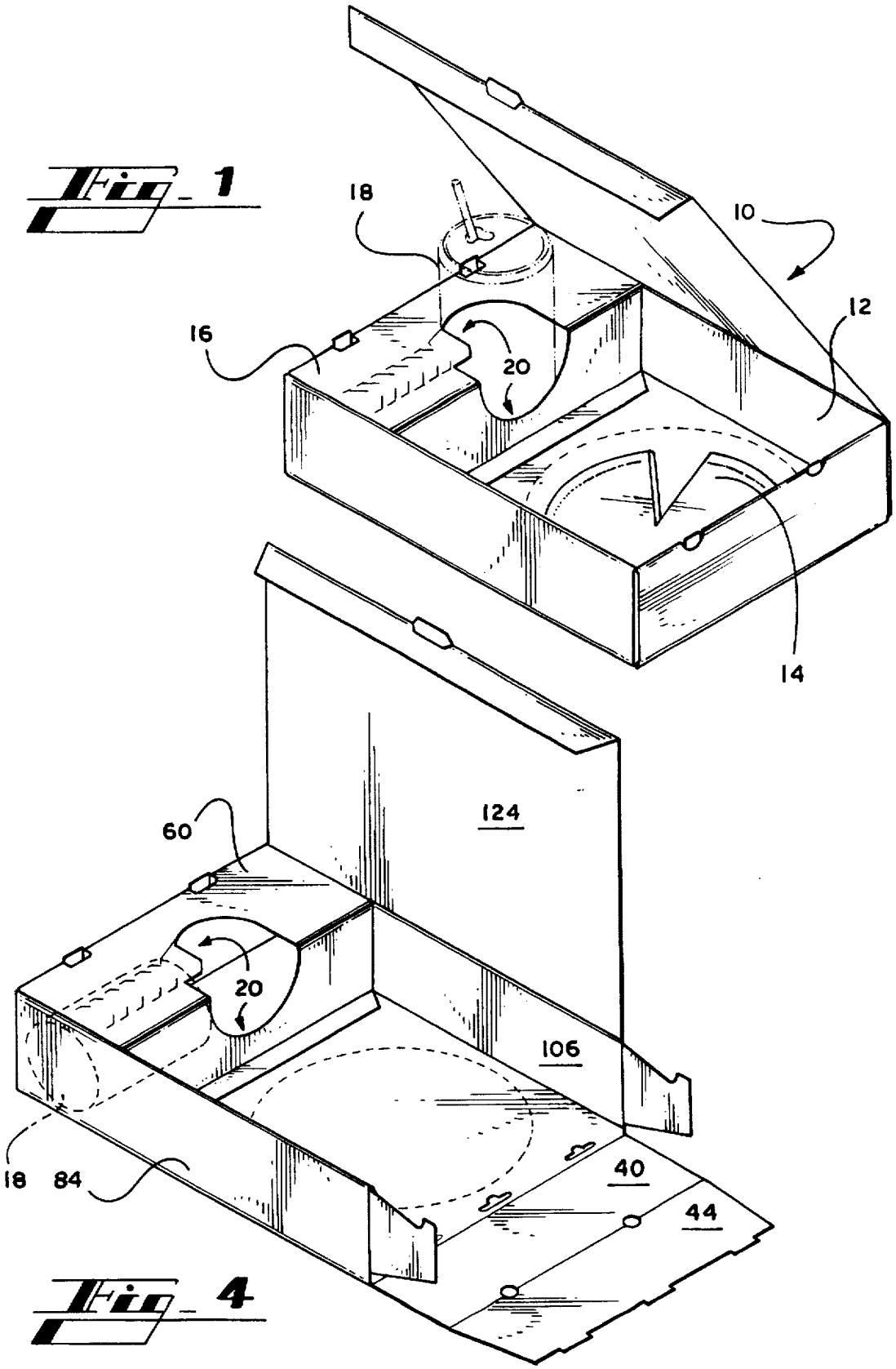
FIG. 1 is a perspective view of a preferred embodiment of a set-up compartmented tray according to the present invention.
FIG. 4 illustrates further assembly of the blank of FIG. 2.

Referring to FIGS. 1–4, a compartmented tray 10 contains a food compartment 12 for transporting food 14 and a tubular beverage compartment 16 for transporting a stored beverage container 18. The tubular compartment 16 contains an opening 20 through which an article such as a stored beverage container 18 is removed and subsequently held upright. The tray 10 is formed from a blank 22 of material containing a number of individual panels and containing fold lines along which the panels are folded to assemble the container. The outside of the tray 10 (shown face down in the blank 22 of FIG. 2) may be printed, decorated or covered with decorative foil or paper for aesthetic appeal.

Figure 2:
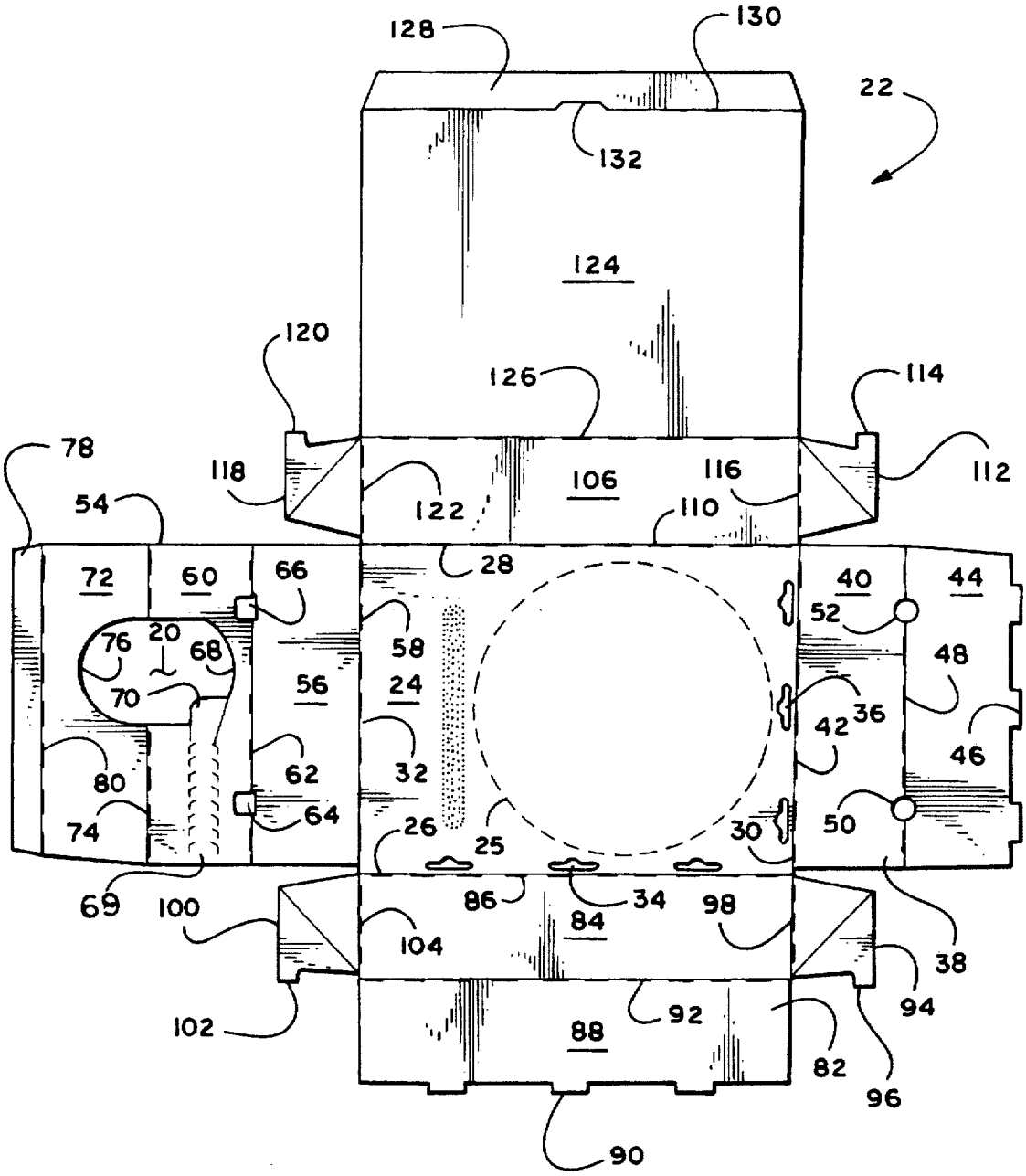
FIG. 2 is a plan view of a blank from which the compartmented tray of FIG. 1 is formed.

Referring to FIG. 2, the blank 22 contains a bottom panel 24 having horizontally extending front and rear edges 26, 28 and first and second opposed side edges 30, 32 extending vertically between the front and rear edges 26, 28. A plurality of receiving slots 34 are formed in the bottom panel 24 along the front edge 26, and another plurality of receiving slots 36 are formed in the bottom panel 24 along the first side edge 30. Each receiving slot 34, 36 is elongated.

A first sidewall panel 38 has an outer wall panel 40 attached along a first vertical fold line 42 at a bottom edge of the outer wall panel 40 to the first side edge 30 of the bottom panel 24. The first sidewall panel 38 has an inner wall panel 44 with tabs 46 along its bottom edge with a top edge joined along a second vertical fold line 48 to a top edge of the outer wall panel 40. Each tab 46 is preferably a straight rectangular protrusion with its long side parallel to first side edge 42 and its short side perpendicular to side edge 42. Each tab 46 fits into an associated slot 36 when the blank 22 is assembled into tray 10. The slot protrusion permits a slot to deform slightly to accept a tab and then grip the tab as the slot reforms. The inner and outer wall panels 44, 40 define a front slot 50 and a rear slot 52 along the second fold line 48. In blank 22 slots 50 and 52 appear circular, but when panels 40 and 44 are folded along fold line 48 placing panels 40 and 44 in face to face relation, U-shaped slots are formed.

A second sidewall panel 54 has an outer wall panel 56 attached along a third vertical fold line 58 at a bottom edge of the outer wall panel 56 to the second side edge 32 of the bottom panel 24. A top wall panel 60 is attached along a fourth vertical fold line 62 at a first side edge of the top wall panel 60 to a top edge of the outer wall panel 56. The top wall panel 60 defines front and rear receiving slots 64, 66 and a central opening 68 adjacent a second side edge and defines two rows of perforations extending vertically from the opening 68 forming a tear strip 69 with a pull tab 70. Receiving slots, 64, 66 are preferably square extending to fold line 62 so that fold line 62 is contiguous with one side of each square. Slot 64 is located on one side of central opening 68 and slot 66 is located on the other side of opening 68. Central opening 68 has an arcuate segment running with and spaced from vertical fold line 62. One end of the arcuate segment is joined to a straight segment extending to the second side edge of top wall panel 60. The other end of the arcuate segment is joined to a corner of the tab of pull tab 70 which is joined to a straight segment extending to the second side edge of top wall panel 60. When the pull tab 70 is grasped and lifted with a thumb and index finger, the tear strip 69 separates along the two rows of perforations creating a slot that effectively enlarges central opening 68.

An inner wall panel 72 is attached along a fifth vertical fold line 74 at a top edge of the inner wall panel 72 to a second side edge of the top wall panel 60 with inner wall panel 72 defining an opening 76 adjacent the top edge that merges with opening 68 in the top wall panel 60. Opening 76 is preferably a semicircle with its ends joined to straight segments extending to the top edge of inner wall panel 72. Openings 68 and 76 merge at fold line 74 to form central opening 20 through which the stored beverage container 18 is retrieved. A glue flap 78 is attached along a sixth vertical fold line 80 at a bottom edge of the inner wall panel 72. During partial assembly the glue flap 78 is fastened to the bottom panel 24.

A front sidewall panel 82 has an outer wall panel 84 attached along a seventh horizontal fold line 86 at a bottom edge of the outer wall panel 84 to the front edge 26 of the bottom panel 24. An inner wall panel 88 has a series of tabs 90 along its bottom edge and has its top edge joined along an eighth horizontal fold line 92 to a top edge of the outer wall panel 84. Each tab 90 is preferably a straight rectangular protrusion with its long sides parallel to front edge 26 and its short sides perpendicular to front edge 26. Each tab 90 fits into a slot 34 during container assembly by slightly deforming slot 34 to accept tab 90.

A first end panel 94 with a first locking tab 96 is attached to one end of outer wall panel 84 along a ninth vertical fold line 98 and a second end panel 100 with a second locking tab 102 is attached to the other end of outer wall panel 84 along a tenth vertical fold line 104. The locking tab 96 is a rectangular protrusion with one side of the rectangle being an extension of the vertical end of end panel 94 that is distant from fold line 98, and another parallel side extending outward from end panel 94 in a direction perpendicular to horizontal fold line 92. The inside corner at the intersection of tab 96 and end panel 94 is preferably radiussed to prevent tearing and facilitate insertion into front slot 50. End panels 94 and 100 may each have a diagonal fold line along which each panel is resiliently folded to facilitate insertion into an appropriate slot during container assembly. Tab 102 is a mirror image of tab 96 and fits in front receiving slot 64 when the container is assembled.

Still referring to FIG. 2, a rear sidewall panel 106 is attached along an eleventh horizontal fold line 110 at a bottom edge of rear panel 106 to the rear edge 28 of the bottom panel 24. A first end panel 112 with a first locking tab 114 is attached to one end of rear panel 106 along a twelfth vertical fold line 116 and a second end panel 118 with a second locking tab 120 is attached to the other end of rear panel 106 along a thirteenth vertical fold line 122. Tab 114 mates with rear opening 52 and is a mirror image of tab 96. Similarly, tab 120 mates with rear opening 66 and is a mirror image of tab 114. A top panel 124 is attached along a fourteenth horizontal fold line 126 at a bottom edge of the top panel 124 to a top edge of the rear panel 106.

A tapered flap 128 is attached along a fifteenth horizontal fold line 130 at a bottom edge of the flap 128 to a top edge of the top panel 124. Preferably, a lip 132 extends from the top 124 forming an indentation in the flap 128. When the container is assembled, the lip 132 rests on top of the front sidewall to facilitate raising a closed top 124 which rests on the front sidewall and top wall panel 60 of the second sidewall panel 54. Lip 132 also helps prevent the top 124 from dropping into the interior of the assembled container.

Assembly of the tray 10 from the blank 22 begins by applying glue to the bottom panel 24, as indicated by the stippling in FIG. 2, to form the tubular compartment. The top panel 60 is folded over onto sidewall panel 56 by folding along fold line 62 to bring the glue flap 78 into contact with the glue applied to the bottom panel. This preassembly is preferably performed at the factory, but a self-stick adhesive can be applied to glue flap 78 and the complete assembly performed by the food server as needed.

Figure 3:
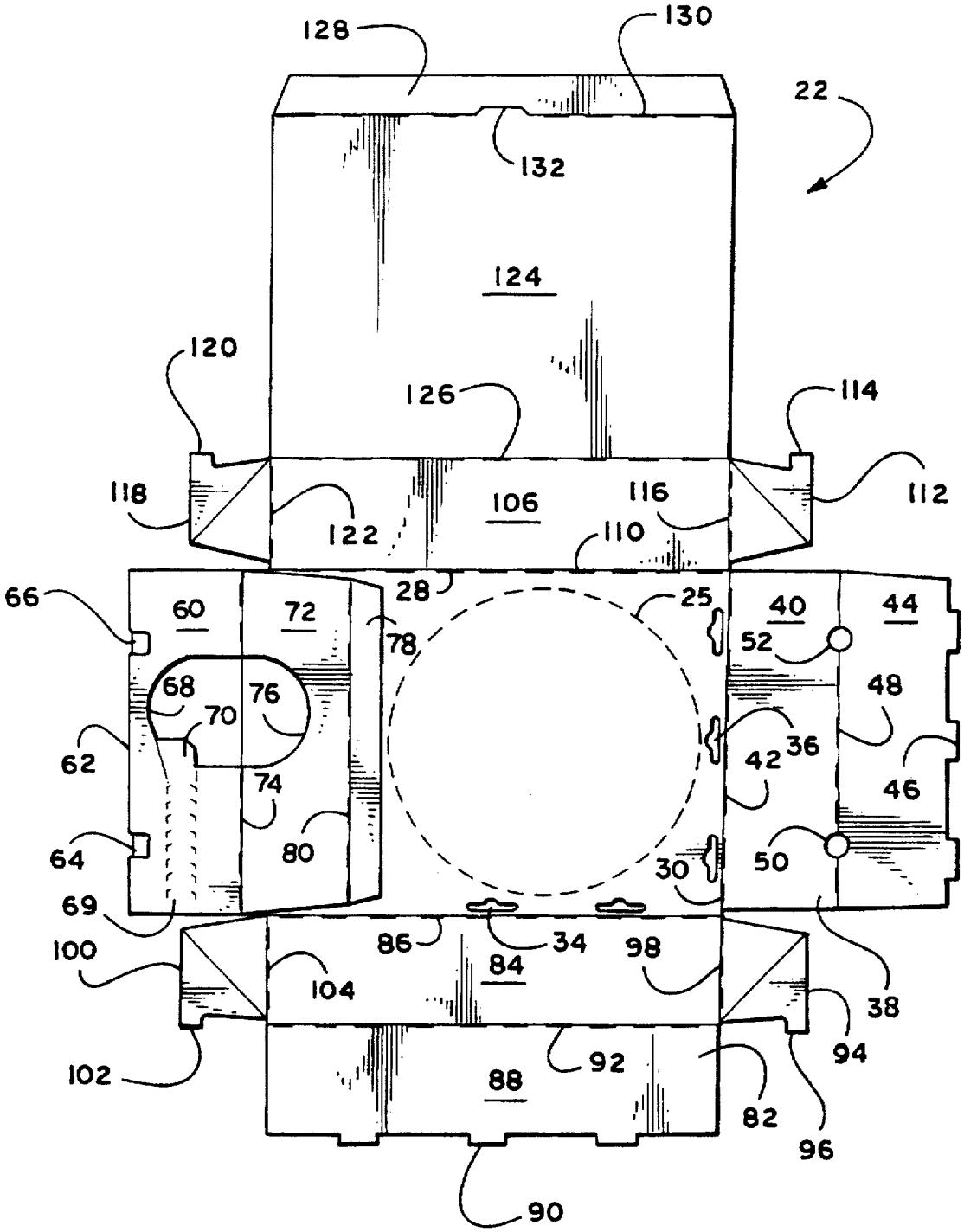
FIG. 3 illustrates the blank of FIG. 2 partially assembled.

FIG. 3 illustrates partial assembly of the blank wherein the blank is still flattened for shipping to the food server. In the preferred embodiment illustrated, the tubular compartment is collapsible about lines where the walls 56, 72 adjoin the bottom wall panel 24. FIG. 4 illustrates partial assembly wherein the blank is set up by lifting up top panel 60 or inner wall panel 72 by folding along fold lines 74 and 80, respectively, forming the outer sidewall and inner sidewall of the container. The glue flap 78, in addition to anchoring the outer and inner walls, serves as a stiffening rib for the bottom of the container. Additional stiffening of the bottom is achieved by adding ribs or an embossment on the bottom side of the bottom as shown by the dashed lines 25 in FIG. 2.

Assembly continues by folding front inner panel 88 along fold lines 92 onto front outer panel 84 thereby forming the front sidewalls of the container. Tabs 90 are inserted into the slots 34 when panels 88 and 84 are folded onto one another End flaps 94 and 100 are folded upward perpendicular to the front sidewall. The front sidewall is then folded along the fold line 86 as the left end panel 100 is guided into the front open end of the second compartment 16 formed by the bottom wall, inner and outer second outer and intermediate sidewalls and the top wall, that is bottom wall 24, second outer sidewall 72, intermediate sidewall 56, and top wall 60. The upstanding tab 102 is guided into the front opening 64 to lock the front panel in an upright position.

At the rear of the container, the rear wall 106 is folded along the folder line 110 to an upright position and the top 124 is folded along fold line 126 so that it overlies the bottom panel 24. End panels 112 and 118 are then folded along fold lines 116 and 122, respectively. End panel 118 is then inserted into the rear end of the second compartment 16 and the locking tab 120 is guided into the rear receiving opening 66. On the right side of the container, outer sidewall flap panel 40 is folded upward along fold line 42, end panels 94 and 112 are brought into contact with the inside of outer sidewall panel 40 while inner sidewall panel 44 is folded along fold line 48 to enclose the end flaps 94, 112. As panel 44 is folded over outer panel 40, the locking tabs 96, 114 are guided into their respective receiving openings 50, 52.

Tabs 46 are inserted into slots 36 as the inner panel 44 is folded over onto the outer panel 40 and end panels 94, 112. Flap 128 is now folded along fold line 130 exposing lip 132 which completes assembly of the container except for closing the container after the food items are inserted. At this stage of the assembly, the beverage containers are preferably inserted into the second compartment 16. The food items are now inserted or placed in the first compartment 12 on the bottom panel 24 of the box for shipping or delivers.

It can now be appreciated that there has been presented a compartmented tray which may be used as a multiple product shipping container. The container has a tray-like first compartment for transporting the food items and a tubular second compartment for transporting beverage containers. The cold beverage containers are separated from the hot food by the inner wall panel which isolates the hot food compartment from the cold beverage compartment. The double wall construction of the front side wall and the first sidewall help strengthen the container and insulates hot food items from the outside environment.

The multiple product container is very useful as a pizza and beverage container because it holds the hot pizza in the tray compartment away from a cold beverage in the tubular compartment. It is also very useful at stadium events because it provides a holder for an opened beverage container.

As is evident from the foregoing description, certain aspects of the invention are not limited to the particular details of the examples illustrated, and it is therefore contemplated that other modifications and applications will occur to those skilled in the art. For example, the container can be assembled from the blank using a different sequence of steps than described, and, while a unitary blank is preferred, a multi-piece blank can be used. Also, the vertical and horizontal fold lines can be scored with a series of alternating working scores and pre-break scores wherein adjoining panels may separate slightly when sharply folded at the pre-break scores. Also, the preferred embodiment illustrated and described above employs a combination of slots and tabs to erect the walls of the tray and compartments, however, other means used in the packaging arts, such as adhesion of panels to one another, may be used. It is also to be noted that the invention is useful as a tray without all of the side walls which surround the tray's perimeter. It is accordingly intended that the claims shall cover all such modifications and applications as do not depart from the true spirit and scope of the invention.

What is claimed is:

1. A compartmented tray comprising:

a tray portion including a tray bottom wall panel; and at least one tubular compartment including walls which include a bottom tube wall panel integrally formed with said tray bottom wall panel, and a top tube wall panel and an adjacent side tube wall panel, said at least one tubular compartment disposed adjacent and forming a side wall of said tray portion, having at least one aperture disposed at an intersection of and extending into said top wall panel and said side wall panel for retention of an elongated object in upright condition, and having a tear strip extending from a perimeter of said at least one aperture longitudinally along said tubular compartment;

wherein the compartmented tray is erectable from a substantially flat collapsed condition wherein said at least one tubular compartment is collapsible about lines of joinder between said walls of said at least one tubular compartment and said tube bottom wall panel and said tray bottom wall panel.

2. The compartmented tray of claim 1, further comprising a plurality of tray side wall panels extending upwardly from said tray bottom wall panel, adjoining one another and said at least one tubular compartment so as to form a walled tray compartment for said tray portion.

3. The compartmented tray of claim 1, further including a plurality of tray side walls foldably adjoining said tray bottom wall panel at edges thereof pivotable between a collapsed condition substantially coplanar with said bottom wall panel and an erected substantially upright condition.

4. A blank for forming a compartmented tray comprising:

a bottom wall panel having a plurality of perimeter edges; and a plurality of elongated foldably adjoining tube panels foldably adjoined to at least one of said perimeter edges such that an unattached edge of said plurality of foldably adjoining tube panels is attachable to said bottom wall panel forming said plurality of elongated foldably adjoining tube panels into a tubular compartment collapsible about lines of joinder between said plurality of elongated foldably adjoining tube panels and said tray bottom wall panel, and which forms a side wall of a tray when the compartmented tray is erected, said plurality of elongated foldably adjoining tube panels including adjacent ones which become disposed as a top tube wall and an adjacent side tube wall when the compartmented tray is erected, said adjacent ones having at least one aperture disposed at an intersection thereof and extending therein to for retention of an elongated object in upright condition in the erected compartmented tray and having a tear strip extending from a perimeter of said at least one aperture longitudinally along one of said adjacent ones.

5. The blank of claim 4, further comprising a plurality of wall panels foldably adjoined to respective unjoined ones of said plurality of perimeter edges of said bottom wall panel erectable into upright walls to form walls for the compartmented tray.

* * * * *